US008578900B2

(12) United States Patent
Kikuoka et al.

(10) Patent No.: US 8,578,900 B2
(45) Date of Patent: Nov. 12, 2013

(54) VALVE TIMING CONTROLLER FOR INTERNAL COMBUSTION ENGINE

(75) Inventors: Shinichiro Kikuoka, Miyoshi (JP); Masaki Numakura, Toyota (JP)

(73) Assignee: Toyota Jidosha Kabushiki Kaisha, Aichi-ken (JP)

( * ) Notice: Subject to any disclaimer, the term of this patent is extended or adjusted under 35 U.S.C. 154(b) by 3 days.

(21) Appl. No.: 13/515,708

(22) PCT Filed: May 18, 2011

(86) PCT No.: PCT/JP2011/061450

§ 371 (c)(1),
(2), (4) Date: Jun. 13, 2012

(87) PCT Pub. No.: WO2012/157098

PCT Pub. Date: Nov. 22, 2012

(65) Prior Publication Data

US 2013/0032108 A1 Feb. 7, 2013

(51) Int. Cl.
*F01L 1/34* (2006.01)

(52) U.S. Cl.
USPC ..... 123/90.17; 464/160

(58) Field of Classification Search
USPC ..... 123/90.15, 90.17; 464/1, 2, 160
See application file for complete search history.

(56) References Cited

U.S. PATENT DOCUMENTS

| | | | | |
|---|---|---|---|---|
| 7,159,545 | B2 * | 1/2007 | Miyakoshi et al. | 123/90.15 |
| 2003/0196622 | A1 | 10/2003 | Wada et al. | |
| 2010/0212615 | A1 | 8/2010 | Suzuki et al. | |

FOREIGN PATENT DOCUMENTS

| | | | |
|---|---|---|---|
| JP | 11-241608 | A | 9/1999 |
| JP | 2002-122009 | A | 4/2002 |
| JP | 2003-314217 | A | 11/2003 |
| JP | 2010-223212 | A | 10/2010 |
| JP | 2011-085074 | A | 4/2011 |
| JP | 2011-185100 | A | 9/2011 |
| JP | 2012-002081 | A | 1/2012 |

* cited by examiner

*Primary Examiner* — Ching Chang
(74) *Attorney, Agent, or Firm* — Sughrue Mion, PLLC

(57) ABSTRACT

A profile of a cam (33) of a camshaft (32) is set based on a relationship of a stop position of a vane rotor (36) at a most retarded phase relative to a housing rotor (37). In other words, the profile of the cam (33) arranged in the camshaft (32) is set so that a second opening (110B) of a communication passage (100), which opens in a second retardment chamber (52B), is located upward in a vertical direction from the axis C of the camshaft (32) when the camshaft (32) is at a neutral position, that is, when torque applied from the cam (33) to the camshaft (32) is the smallest.

9 Claims, 6 Drawing Sheets

VALVE TIMING CONTROLLER FOR INTERNAL COMBUSTION ENGINE

CROSS REFERENCE TO RELATED APPLICATIONS

This application is a National Stage of International Application No. PCT/JP2011/061450 filed May 18, 2011, the contents of all of which are incorporated herein by reference in their entirety.

FIELD OF THE INVENTION

The present invention relates to a valve timing controller for an internal combustion engine that controls valve timing in accordance with an engine operation state.

BACKGROUND OF THE INVENTION

Patent document 1 describes an example of a known valve timing controller of the internal combustion engine. Such a valve timing controller, including that described in patent document 1, is provided with a variable mechanism including a first rotating body, which moves in cooperation with a crankshaft, and a second rotating body, which moves in cooperation with a camshaft. The variable mechanism supplies and discharges hydraulic oil to and from a plurality of hydraulic pressure chambers defined by the rotating bodies to relatively rotate the rotation bodies about the same axis and control the rotation phase of the camshaft relative to the crankshaft, that is, control the valve timing at a phase corresponding to the engine operation state. The supply and discharge of the hydraulic oil to the hydraulic pressure chambers are performed through a supply/discharge path extending from the respective hydraulic pressure chamber towards the axis of the rotating bodies.

In addition to the variable mechanism, the valve timing controller includes a lock mechanism that locks the valve timing at a specific phase by restricting relative rotation of the two rotating bodies when the hydraulic pressure of the hydraulic pressure chamber is low.

PRIOR ART DOCUMENT

Patent Document

Patent Document 1: Japanese Laid-Open Patent Publication No. 2002-122009

SUMMARY OF THE INVENTION

If the valve timing is not locked at the specific phase described above when the engine is stopped, fluctuation of the cam torque is used to swing the second rotating body to the advancing side or the retarding side so that the valve timing becomes locked at the specific phase when the engine starts. However, when the engine is started, if a large amount of hydraulic oil is remaining in the hydraulic pressure chambers of the variable mechanism, the remaining hydraulic oil obstructs the swinging of the second rotating body. It is thus difficult to lock the valve timing at a specific phase by using fluctuation of the cam torque to swing the second rotating body as described above.

Accordingly, it is an object of the present invention to provide a valve timing controller for an internal combustion engine that can readily discharge the hydraulic oil remaining in a hydraulic pressure chamber when the engine is stopped.

A valve timing controller for an internal combustion engine according to the present invention includes a variable mechanism that varies a relative rotation phase of a first rotating body, which moves in cooperation with a crankshaft, and a second rotating body, which moves in cooperation with a camshaft and rotates about the same axis as the first rotating body, based on hydraulic pressure of a plurality of hydraulic pressure chambers defined by the two rotating bodies; a lock mechanism that locks the relative rotation phase at a specific phase; and a plurality of discharge passages that extend from the plurality of hydraulic pressure chambers towards the axis to discharge hydraulic oil from each of the plurality of hydraulic pressure chambers. The valve timing controller of the internal combustion engine includes an open-to-atmosphere mechanism that communicates an open chamber, which is one of the plurality of hydraulic pressure chambers, with the exterior when the engine is stopped to draw air into the open chamber; and a communication passage that communicates a drawing chamber, which is one of the plurality of hydraulic pressure chambers that differs from the open chamber, with the open chamber. The communication passage includes an opening that opens to the open chamber. A stop phase adjustment mechanism that adjusts a stop phase of at least one of the two rotating bodes so that the opening of the communication passage is located upward in a vertical direction from the axis when the engine is stopped.

In such a valve timing controller, when the engine is stopped and, for example, the open chamber of the plurality of hydraulic pressure chambers stops at a position upward in the vertical direction from the axis of the two rotating bodies, the open-to atmosphere mechanism directly draws air into the open chamber. This discharges the hydraulic oil filled in the open chamber through the discharge passage.

When the engine is stopped and, for example, the drawing chamber of the plurality of hydraulic pressure chambers stops at a position upward in the vertical direction from the axis of the two rotating bodies, the air drawn into the open chamber by the open-to atmosphere mechanism is sent to the drawing chamber through the communication passage. This discharges the hydraulic oil filled in the drawing passage through the discharge passage. In this case, to readily discharge hydraulic oil from the discharge passage through the discharge passage, more air is required to be sent from the open chamber into the communication passage through the opening of the communication chamber. However, when the opening of the communication passage is stopped downward in the vertical direction from the axis (downwardly stopped), the vicinity of the opening is maintained in a state filled with hydraulic oil, or an oil-filled state. Thus, even when a predetermined time elapses from when the engine is stopped, a void resulting from the discharge of hydraulic oil is not formed in the vicinity of the opening of the open chamber, and the flow of air from the open chamber to the opening of the communication passage is obstructed by hydraulic oil. This adversely affects the efficiency for drawing air into the drawing chamber.

In this invention, when the engine is stopped, the stop phase adjustment mechanism adjusts the stop phase of at least one of the two rotating bodies so that the opening of the communication passage that opens to the open chamber stops at a position upward in the vertical direction from the axis (upwardly stopped). This resolves the oil-filled state of the open chamber when a certain amount of hydraulic oil flows out of the open chamber through the communication chamber. This forms a void in the vicinity of the opening. After the formation of the void, air flows into the opening of the communication passage without being obstructed by hydraulic oil. This efficiently draws air into the drawing chamber.

In the valve timing controller including the lock mechanism that locks the valve timing at a specific phase, when the valve timing is not locked at a specific phase as the engine stops, the valve timing often becomes a relatively retarded phase due to the influence of cam friction or the like. Thus, the hydraulic oil remaining in the advancement chamber among the hydraulic pressure chambers is easier to discharge that the hydraulic oil remaining in the retardment chamber. That is, when the engine is stopped without the valve timing being locked at a specific phase, it can be said that there is a stronger demand for readily discharging hydraulic oil particularly from the retardment chamber.

It is desirable that for the open chamber and the drawing chamber to be different retardment chambers that retard the valve timing. In this case, when the open-to-atmosphere mechanism draws air into the open chamber that serves as the retardment chamber, a large amount of air is drawn into the drawing chamber, which is a retardment chamber that differs from the open chamber through the communication passage. As a result, even when the valve timing is stopped at the retardment side in a state in which the engine is stopped, hydraulic oil is readily discharged from the drawing chamber, or the retardment chamber, through the discharge passage.

When the engine stops, there is a high probability that the rotation of the camshaft will stop at a position (neutral position) at which the torque applied to the camshaft from the cam formed on the camshaft is the smallest. Thus, in a structure in which an opening is formed in the second rotating body, by setting the profile of the can so that the opening will stop at an upward position when the camshaft is at the neutral position, a void can be formed in the vicinity of the opening. This obtains the advantages described above.

As described above, when the valve timing is not locked at a specific phase as the engine stops, the valve timing often becomes a relatively retarded phase due to the influence of cam friction or the like. More particularly, in such a case, the valve timing is most often at the most retarded phase. In this state, the retardment chamber is in an oil-sealed state if hydraulic oil is not appropriately discharged from each retardment chamber. Thus, when the rotation of the camshaft rotates the second rotating body, the first rotating body rotates in cooperation with the first rotating body. In other words, the two rotating bodies are rotated integrally. Thus, in a structure in which an opening is formed in the first rotating body, by setting the profile of the cam so that the opening is upwardly stopped when the camshaft is at the neutral position, a void is formed in the vicinity of the opening. This obtains the advantages described above.

Further, as a specific structure of the stop phase adjustment mechanism, in addition to setting the cam profile as described above, the opening may be arranged in the first rotating body, and an engine starting device may be driven to rotate the crankshaft and adjust the stop position of the first rotating body when the engine is stopped so that the opening is upwardly stopped. As described above, when the valve timing is not locked at a specific phase as the engine stops, the valve timing often becomes a relatively retarded phase, and the probability of the two rotating bodies rotating integrally becomes high. Thus, in a structure in which the opening is arranged in the second rotating body, when the engine is stopped and the valve timing is at the most retarded phase, the engine starting device is driven to rotate the crankshaft and adjust the first rotating body at the stop phase so that the opening is upwardly stopped. This adjusts the stop phase of the second rotating body so that a void is formed in the vicinity of the opening and obtains the advantages described above.

Additionally, when the opening is arranged in the first rotating body, the stop phase adjustment mechanism may be employed to control load of an auxiliary machine, which is driven by the crankshaft, when the engine is stopped. Such a structure adjusts the stop phase of the crankshaft and adjusts the stop phase of the first rotating body to upwardly stop the opening when the engine stops. As described above, when the valve timing is not locked at a specific phase as the engine stops, the probability of the valve timing becoming the most retarded phase and the two rotating bodies rotating integrally becomes high. Thus, in a structure in which the opening is arranged in the second rotating body, the stop phase adjustment mechanism may be employed to control the load of the auxiliary machine driving by the crankshaft when the engine is stopped and the valve timing is at the most retarded phase. This allows the opening to be upwardly stopped, forms a void in the vicinity of the opening, and obtains the advantages described above. An example of the auxiliary machine is a rotation type pump driving by an electric generator or the crankshaft.

As described above, when the valve timing is not locked at a specific phase as the engine stops, the valve timing is often gradually retarded due to the influence of cam friction or the like. Thus, for example, in a variable mechanism in which the specific phase is set at the most retarded phase, the necessity for discharging hydraulic oil from the hydraulic pressure chamber becomes low. In a variable mechanism in which the specific phase is set at an intermediate phase between the most advanced phase and the most retarded phase, the necessity for swinging the second rotation body becomes high. Thus, in a variable mechanism in which the specific phase is set at the intermediate phase, hydraulic oil is readily discharged from the hydraulic pressure chamber. This further prominently obtains the advantages described above.

DETAILED DESCRIPTION OF THE PREFERRED EMBODIMENTS

The overall structure of a valve timing controller will now be described with reference to FIG. 1. The valve timing controller controls the valve timing of an intake valve 31.

Figure 1:
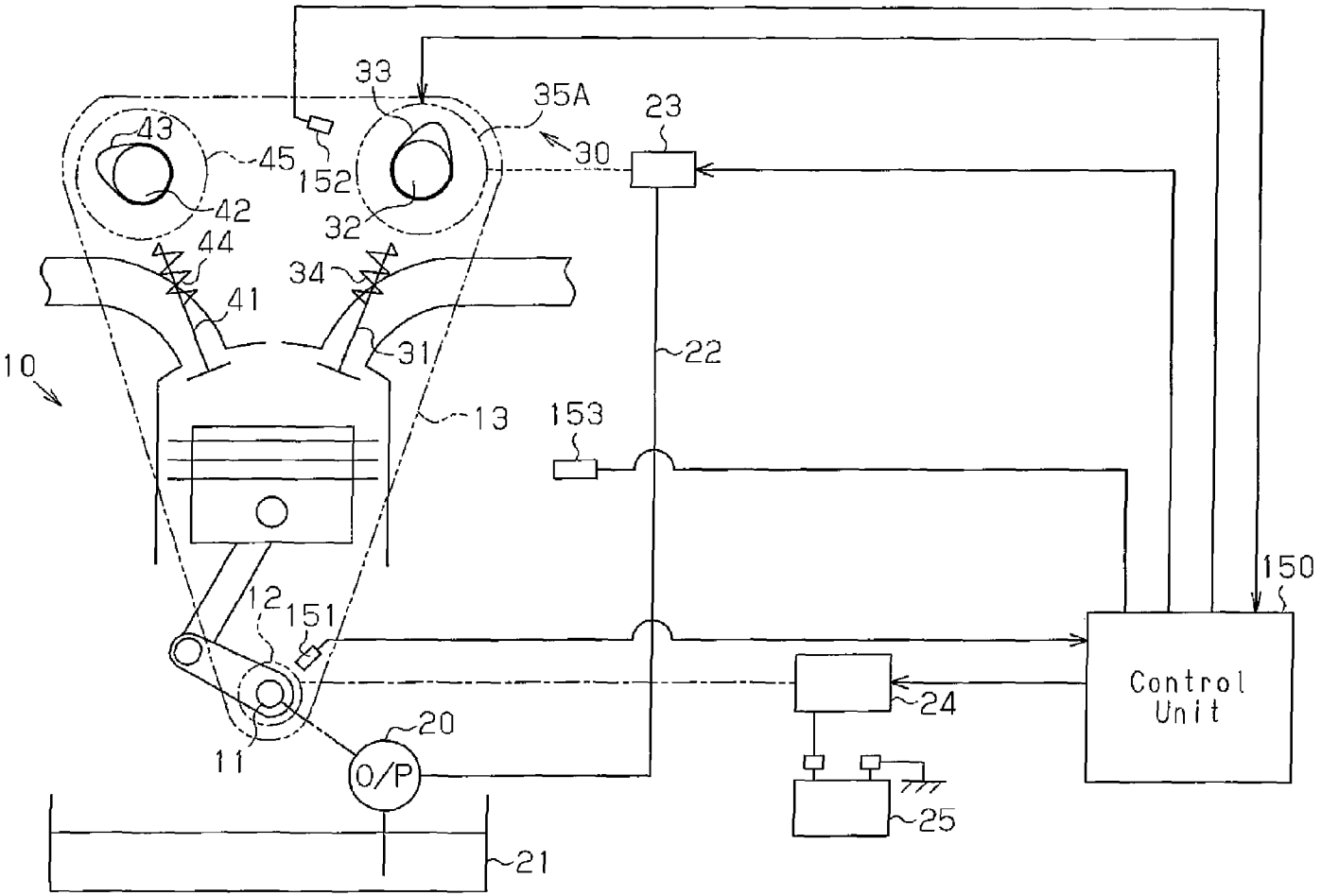
FIG. 1 is a schematic diagram of a valve timing controller according to one embodiment of the present invention and an internal combustion engine to which the controller is applied.

As shown in FIG. 1, an intake camshaft 32, which opens and closes the intake valve 31, and an exhaust camshaft 42, which opens and closes an exhaust valve 41, are arranged to be rotatable above an internal combustion engine 10. The intake camshaft 32 includes a variable mechanism 30 that varies the valve timing of the intake valve 31. A sprocket 35A of the intake camshaft 32, a sprocket 45 of the exhaust camshaft 42, and a sprocket 12 of a crankshaft 11 in the variable mechanism 30 are driven and coupled by a timing chain 13. Thus, when the crankshaft 11 is rotated, the torque is transmitted to the sprockets 35A and 45 by the timing chain 13 thereby rotating the intake camshaft 32 and the exhaust camshaft 42.

An intake valve spring 34 urges the intake valve 31 in a valve closing direction. When the intake camshaft 32 is rotated, by a cam 33 of the camshaft 32 pushes and opens the intake valve 31 against the elastic force of the valve spring 34. An exhaust valve spring 44 urges the exhaust valve 41 in a valve closing direction. When the exhaust camshaft 42 is rotated, a cam 43 of the camshaft 42 pushes the exhaust valve 41 against an elastic force of the valve spring 44.

An oil pan 21, which stores hydraulic oil, is coupled to a lower part of the internal combustion engine 10, and an oil pump 20 driven by the torque of the crankshaft 11 draws in hydraulic oil from the oil pan 21 and discharges the hydraulic oil into a hydraulic oil passage 22. The hydraulic oil passage 22 includes an oil passage control valve 23 for changing a supply/discharge state of the hydraulic oil with respect to each hydraulic pressure chamber (advancement chamber 51, retardment chamber 52) of the variable mechanism 30. In addition to functioning as hydraulic oil that generates hydraulic pressure to drive the variable mechanism 30, the hydraulic oil stored in the oil pan 21 also functions as lubricating oil that lubricates each part of the internal combustion engine 10.

A starter motor 24, which serves as an engine starting device that forcibly rotates (cranking) the crankshaft 11 when starting the internal combustion engine 10, is connected to the crankshaft 11. A battery 25 supplies power to the starter motor 24.

Further, a crank angle sensor 151, a cam angle sensor 152, and a coolant temperature sensor 153 are coupled to the internal combustion engine 10 to detect the engine operation state. The crank angle sensor 151 is arranged in the vicinity of the crankshaft 11 to detect a crank angle CA and engine speed. The cam angle sensor 152 is arranged in the vicinity of the intake camshaft 32 to detect the position of the camshaft 32. The coolant temperature sensor 153 is coupled to a main body of the internal combustion engine 10 to detect the temperature of an engine coolant. Signals output from the various sensors are retrieved by a control unit 150 of the internal combustion engine 10.

The structure of the variable mechanism 30 of the valve timing controller will now be described with reference to FIG. 2.

Figure 2A:
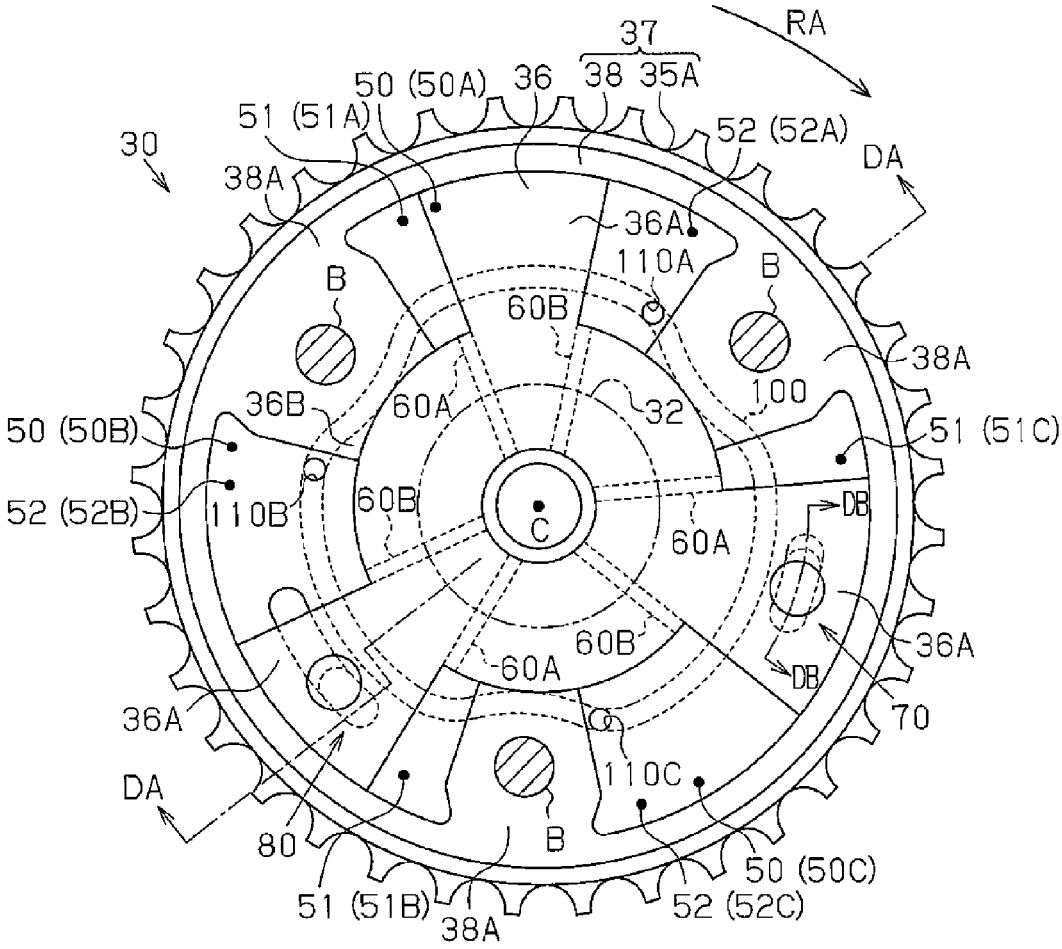
FIG. 2(*a*) is a cross-sectional view showing the cross-sectional structure of a variable mechanism for the valve timing controller, and FIG. 2(*b*) is a cross-sectional view showing the cross-sectional structure taken along line DA-DA in FIG. 2(*a*).
Figure 2B:
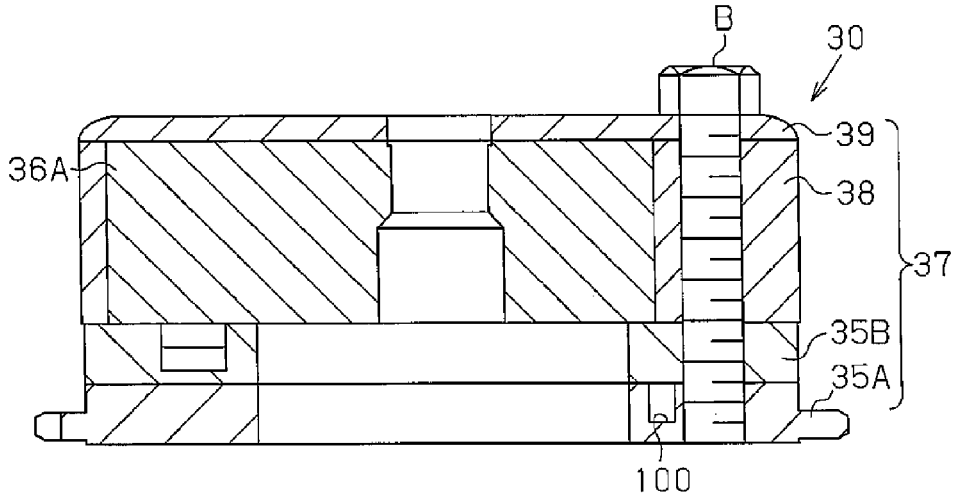

As shown in FIG. 2(*a*), a vane rotor 36 of the variable mechanism 30 includes a boss 36B and three vanes 36A, which extend from the boss 36B outward in the radial direction of the camshaft 32. The boss 36B is fixed to an end of the camshaft 32 to rotate in cooperation with the camshaft 32. A housing rotor 37 of the variable mechanism 30 includes a housing main body 38 and a cover 39. Bolts B fix the sprocket 35A and a plate 35B to one side of the housing main body 38. The bolts B fix the cover 39 to the other side of the housing main body 38. The sprocket 35A is coupled to the crankshaft 11 by the timing chain 13. Thus, the housing rotor 37, that is, the cover 39, the housing main body 38, the plate 35B, and the sprocket 35A integrally rotate about an axis C of the camshaft 32 in the same manner as the vane rotor 36. In the present embodiment, the axis C of the camshaft 32, that is, the axis C of the housing rotor 37 and the vane rotor 36 extends in a horizontal direction.

The housing main body 38 includes three partition walls 38A projecting out in the radial direction of the axis C of the housing rotor 37. Three accommodation chambers 50 (first accommodation chamber 50A, second accommodation chamber 50B, and third accommodation chamber 50C) are formed between the adjacent partition walls 38A. Each accommodation chamber 50 includes a plurality of hydraulic pressure chambers defined by the corresponding vane 36A, namely, an advancement chamber 51 (first advancement chamber 51A, second advancement chamber 51B, and third advancement chamber 51C), and a retardment chamber 52 (first retardment chamber 52A, second retardment chamber 52B, and third retardment chamber 52C).

In each accommodation chamber 50, the advancement chamber 51 is arranged toward the rear from the vane 36A in a rotating direction RA of the camshaft 32. In each accommodation chamber 50, the retardment chamber 52 is arranged toward the front from the vane 36A in the rotating direction RA of the camshaft 32. In the vane rotor 36, an advancement oil passage 60A extends from each advancement chamber 51 towards the axis C of the camshaft 32 to circulate the hydraulic oil supplied to and discharged from each advancement chamber 51. Further, in the vane rotor 36, a retardment oil passage 60B extends from each retardment chamber 52 towards the axis C of the camshaft 32 to circulate the hydraulic oil supplied to and discharged from the retardment chamber 52.

The operation mode of the variable mechanism 30 will now be described.

Hydraulic oil is supplied to each advancement chamber 51 through each advancement oil passage 60A, and hydraulic oil is discharged from each retardment chamber 52 through each retardment oil passage 60B. This rotates the vane rotor 36 toward the advancing side relative to the housing rotor 37, that is, in the rotating direction RA of the camshaft 32 and advances the valve timing. In this manner, when the vane rotor 36 in each accommodation chamber 50 rotates in the rotating direction RA and the vane 36A comes into contact with the partition wall 38A, the valve timing is at the most advanced phase.

Hydraulic oil is supplied to each retardment chamber 52 through each retardment oil passage 60B, and hydraulic oil is discharged from each advancement chamber 51 through each advancement oil passage 60A. This rotates the vane rotor 36 rotates toward the retarding side relative to the housing rotor 37, that is, in the direction opposite to the rotating direction RA of the camshaft 32 and retards the valve timing. In this manner, when the vane rotor 36 in each accommodation chamber 50 rotates in the direction opposite to the rotating direction RA and each vane 36A comes into contact with the partition wall 38A, the valve timing is at the most retarded phase.

Furthermore, in the valve timing controller, lock mechanisms 70 and 80 for locking the valve timing at an intermediate phase, which is a phase between the most advanced phase and the most retarded phase, are arranged on the vane 36A of the third accommodation chamber 50C and the vane 36A of the second accommodation chamber 50B.

The structure of the lock mechanism 70 will now be described with reference to FIG. 3.

A lock pin 71A and an auxiliary pin 71B, which are cylindrical, are arranged in an accommodation hole 72 formed in the vane 36A. The auxiliary pin 71B is fitted onto the lock pin 71A to be movable back and forth. A flange 79, which can contact the auxiliary pin 71B, is arranged on the lock pin 71A.

The upper side of the accommodation hole 72 is closed by a cylindrical spring guide bushing 74. The spring guide bushing 74 is fitted to and supported by the lock pin 71A. A ring bushing 75 is arranged at the lower side of the lock pin 71A.

A main spring 76A, which urges the lock pin 71A in a direction toward the plate 35B (projecting direction), is arranged in an inner circumferential portion of the lock pin 71A, and an auxiliary spring 76B, which urges the auxiliary pin 71B in the projecting direction, is arranged between the spring guide bushing 74 and the auxiliary pin 71B.

In the accommodation hole 72, a release chamber 77 is defined and formed by the inner wall of the accommodation hole 72, the lock pin 71A, the auxiliary pin 71B, and the ring bushing 75. A release oil passage 78 is connected to the release chamber 77 to supply hydraulic oil that moves the auxiliary pin 71B in a direction toward the spring guide bushing 74 (accommodating direction) against the urging force of the auxiliary spring 76B.

A lock groove 73 arranged in the plate 35B includes two grooves having different depths, namely, a lower groove 73A having a relatively large depth and an upper groove 73B, which is arranged at the retarding side of the lower groove 73A and has a smaller depth. An advancement inner wall 73C, which is arranged at the advancing side end of the lower groove 73A, is located at a position set so that when the lock pin 71A is moved in the projecting direction and comes into contact with the advancement inner wall 73C, the valve timing is at the intermediate phase.

The operation mode of the lock mechanism 70 will now be described.

In a state in which a distal end of the lock pin 71A is located in the lock groove 73, the auxiliary pin 71B is moved in the accommodating direction when hydraulic oil is supplied to the release chamber 77 through the release oil passage 78. In this manner, when the auxiliary pin 71B is moved in the accommodating direction and the auxiliary pin 71B comes into contact with the flange 79 of the lock pin 71A, the auxiliary pin 71B and the lock pin 71A are moved integrally in the accommodating direction and accommodated in the accommodation hole 72.

In a state in which the lock pin 71A and the auxiliary pin 71B are accommodated in the accommodation hole 72, the auxiliary pin 71B and the lock pin 71A are both moved in the projecting direction and the distal end of the lock pin 71A is fitted into the lock groove 73 when the hydraulic oil is discharged from the release chamber 77 through the release oil passage 78. Then, when the vane rotor 36 is rotated relative to the housing rotor 37, and the distal end of the lock pin 71A comes into contact with the advancement inner wall 73C, further advancement of the valve timing from the intermediate phase is restricted.

In this manner, the lock mechanism 70 restricts variation of the valve timing to the advancing side. A further lock mechanism 80 has a structure similar to the lock mechanism 70 and thus will not be described. However, the lock mechanism 80 differs in that it restricts variation of the valve timing to the retarding side. The lock mechanism 70 and the lock mechanism 80 cooperate to lock the valve timing at the intermediate phase.

The valve timing controller drives the lock mechanisms 70 and 80 so that the valve timing is locked at the intermediate phase when the engine is stopped. When the engine is stopped without locking the valve timing at the intermediate phase, most of the times, the valve timing is maintained at the most retarded phase due to the discharge of the hydraulic oil from each advancement chamber 51 and each retardment chamber 52. Fluctuation of the cam torque when the engine is started rotates the vane rotor 36 in the advancing direction relative to the housing rotor 37. In this state, the valve timing can be locked at the intermediate phase by discharging hydraulic oil from the release chamber 77 through the release oil passage 78.

However, for example, when the engine is stopped without the valve timing being locked at the intermediate phase and with hydraulic oil remaining in each advancement chamber 51 and each retardment chamber 52, the hydraulic oil obstructs swinging of the vane rotor 36. As a result, it becomes difficult to lock the valve timing at the intermediate phase with the fluctuation of the cam torque when the engine starts. Thus, the valve timing controller of the present embodiment includes an open-to-atmosphere mechanism 90 that draws ambient air into each advancement chamber 51 and each retardment chamber 52 to readily discharge hydraulic oil from each advancement chamber 51 and each retardment chamber 52 when the engine is stopped.

The structure of the open-to-atmosphere mechanism 90 will now be described with reference to FIGS. 3 and 4.

Figure 3:
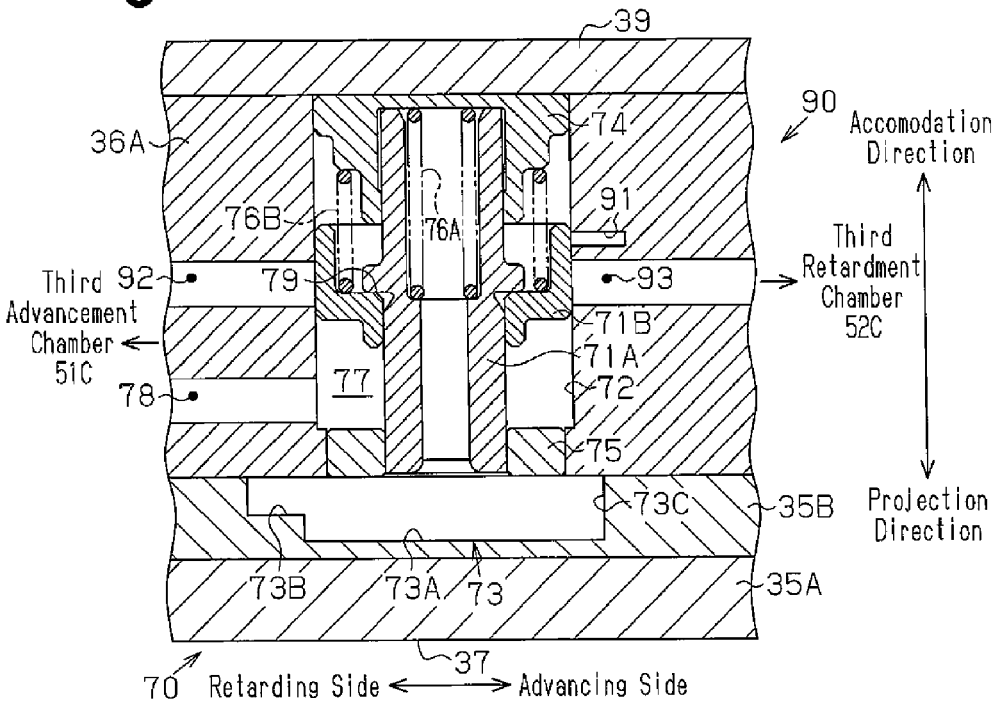
FIG. 3 is a cross-sectional view showing the cross-sectional structure taken along line DB-DB in FIG. 2(*a*).

As shown in FIG. 3, the open-to-atmosphere mechanism 90 includes an open passage 91, which communicates the accommodation hole 72 with the exterior, an advancement chamber open passage 92, which communicates the accommodation hole 72 with the third advancement chamber 51C, and a retardment chamber open passage 93, which communicates the accommodation hole 72 with the third retardment chamber 52C. In addition, the auxiliary pin 71B, the auxiliary spring 76B, the release chamber 77, and the release oil passage 78 described above also function as one part of the open-to-atmosphere mechanism 90.

The operation mode of the open-to-atmosphere mechanism 90 will now be described.

When hydraulic oil is supplied to the release chamber 77 through the release oil passage 78, the auxiliary pin 71B is moved in the accommodating direction as described above. As a result, the open passage 91, the advancement chamber open passage 92, and the retardment chamber open passage 93 are closed by the auxiliary pin 71B. Accordingly, the flow of air between the exterior and the third advancement chamber 51C and the third retardment chamber 52C is blocked.

Figure 4:
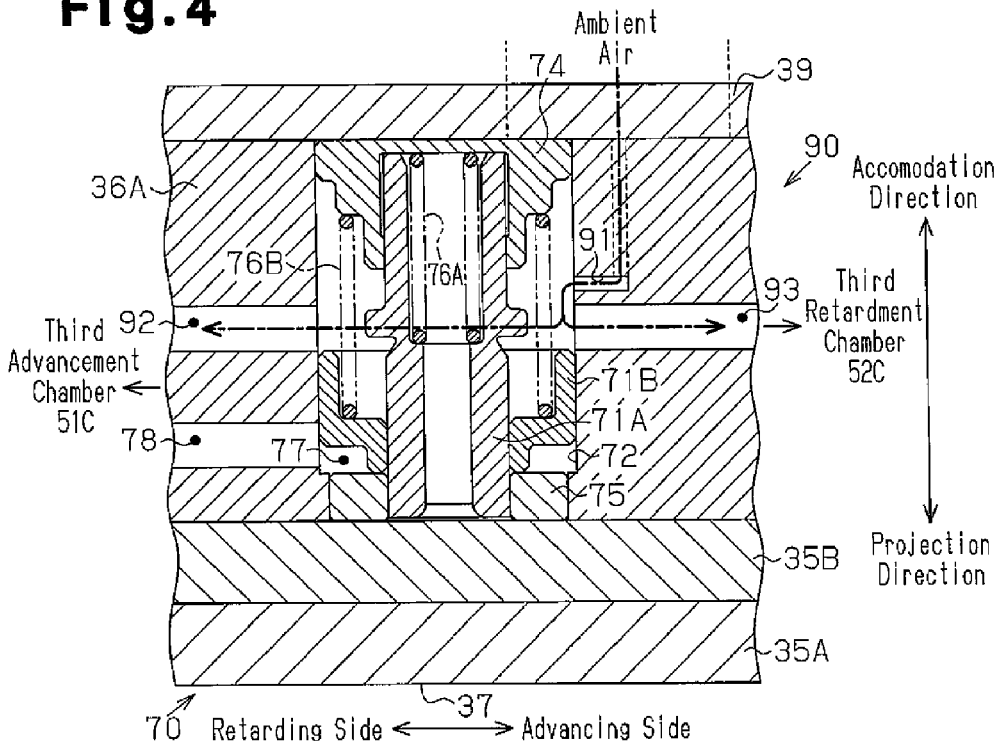
FIG. 4 is a cross-sectional view showing a cross-sectional structure taken alone line DB-DB in FIG. 2(*a*) when a lock mechanism does not perform locking.

When hydraulic oil is discharged from the release chamber 77 through the release oil passage 78, as shown in FIG. 4, the auxiliary pin 71B is moved in the projecting direction as described above. As a result, the open passage 91, the advancement chamber open passage 92, and the retardment chamber open passage 93 open and are not blocked by the auxiliary pin 71B. Accordingly, when ambient air is drawn into the open passage 91, the air is drawn through the advancement chamber open passage 92 into the third advancement chamber 51C and also drawn through the retardment chamber open passage 93 into the third retardment chamber 52C. The vane 36A including the lock mechanism 80 also includes the open-to-atmosphere mechanism 90 in the same manner. Ambient air is drawn through the open-to-atmosphere mechanism 90 into the second advancement chamber 51B and the second retardment chamber 52B. Among the hydraulic pressure chambers 51B, 52B, 51C, and 52C into which ambient air is drawn through the open-to-atmosphere mechanism, the second retardment chamber 52B and the third retardment chamber 52C function as open chambers.

Figure 5:
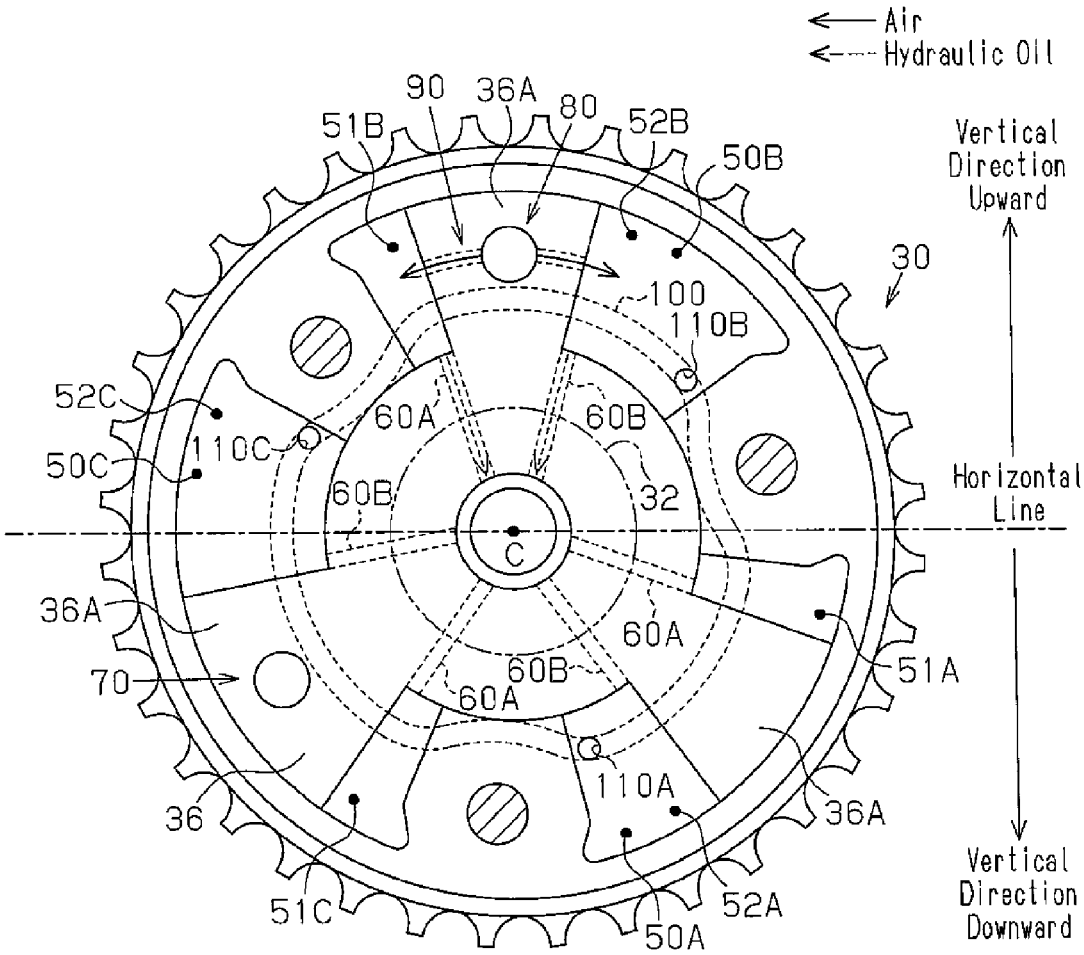
FIG. 5 is a cross-sectional view showing the cross-sectional structure of the variable mechanism.

Accordingly, as shown in FIG. 5, when the rotation of the vane rotor 36 is stopped in a state in which the second advancement chamber 51B and the second retardment chamber 52B, which are defined and formed by the vane 36A including the open-to-atmosphere mechanism 90, are located upward in the vertical direction from the axis C of the camshaft 32, air is directly drawn through the open-to-atmosphere mechanism 90 into the hydraulic pressure chambers 51B and 52B, and hydraulic oil flows from the hydraulic pressure chambers 51B and 52B toward the axis C of the camshaft 32 through the advancement oil passage 60A and the retardment oil passage 60B. This readily discharges the hydraulic oil. Thus, even if the valve timing is not locked at the intermediate phase when the engine is stopped, the valve timing can be advanced or retarded towards the intermediate phase to lock the valve timing at the intermediate phase using the swinging of the vane rotor 36 towards the advancing side or the retarding side resulting from the fluctuation of the cam torque when the engine starts. A single-dashed line in the drawing shows a horizontal line extending through the axis C of the camshaft 32.

The open-to-atmosphere mechanism 90 is not arranged on the vane 36A located between the first advancement chamber 51A and the first retardment chamber 52A. Hence, air is not directly drawn into the hydraulic pressure chambers 51A and 52A. Thus, when the rotation of the vane rotor 36 is stopped in a state in which the hydraulic pressure chambers 51A and 52A are located upward in the vertical direction from the axis C of the camshaft 32, hydraulic oil resists discharge from the hydraulic pressure chambers 51A and 52A. Thus, it becomes difficult to lock the valve timing at the intermediate phase using the swinging of the vane rotor 36, as described above. In particular, when the engine is stopped without the valve timing being locked at the intermediate phase, the valve timing is affected by cam friction and the like and often at a phase that is relatively retarded. Accordingly, among the advancement chamber 51 and retardment chamber 52, it can be said that there is a strong demand to readily discharge hydraulic oil particularly from the retardment chamber 52. A communication passage 100 is thus arranged in the variable mechanism 30 to also draw air from the second retardment chamber 52B and the third retardment chamber 52C into the first retardment chamber 52A with each open-to-atmosphere mechanism 90.

Figure 6A:
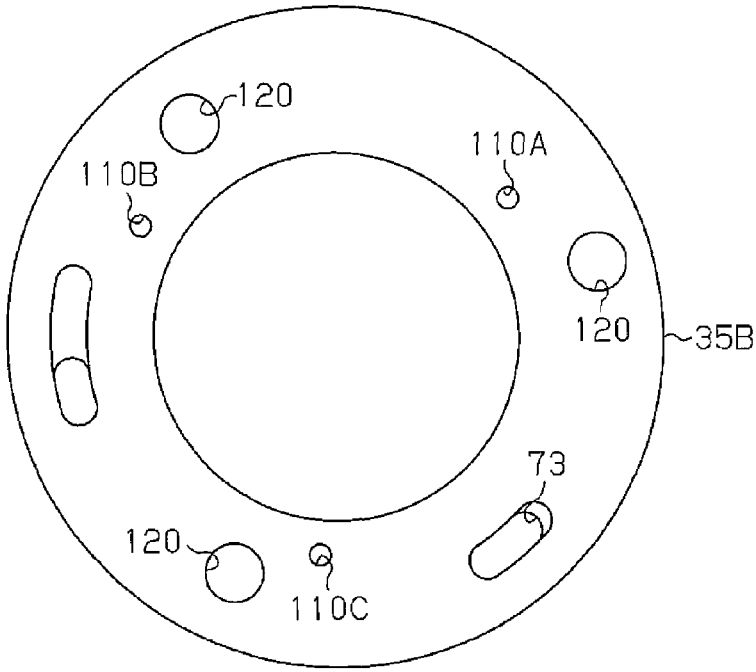
FIG. 6(*a*) is a front view showing the front structure of a plate of the variable mechanism, and FIG. 6(*b*) is a front view showing the front structure of a sprocket of the variable mechanism.
Figure 6B:
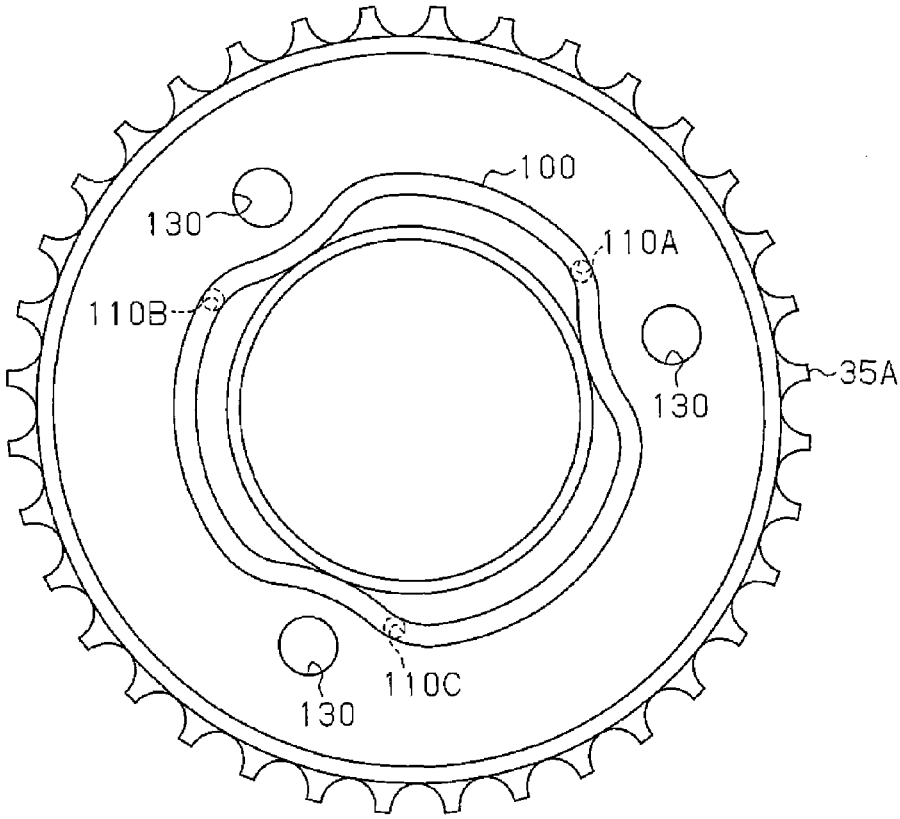

The communication passage 100 will now be described with reference to FIG. 6. FIG. 6(*a*) shows a surface of the plate 35B at the side to which the housing main body 38 is coupled. FIG. 6(*b*) shows a surface of the sprocket 35A at the side to which the housing main body 38 is coupled.

As shown in FIG. 6(*a*), the plate 35B includes a first opening 110A, a second opening 110B, a third opening 110C, and three bolt holes 120 to which the bolts B are fastened. When the plate 35B is coupled to the housing main body 38, the first opening 110A is located at the most advanced side of the first retardment chamber 52A, the second opening 110B is located at the most advanced side of the second retardment chamber 52B, and the third opening 110C is located at the most advanced side of the third retardment chamber 52C.

Further, as shown in FIG. 6(*b*), the sprocket 35A includes the annular communication passage 100, in the surface joined with the plate 35B, and three bolt holes 130, to which the bolts B are fastened. When the plate 35B is coupled to the sprocket 35A, the communication passage 100 and the retardment chambers 52A to 52C are in communication through the openings 110A to 110C. In other words, the retardment chambers 52A to 52C are in communication through the communication passage 100.

Figure 7A:
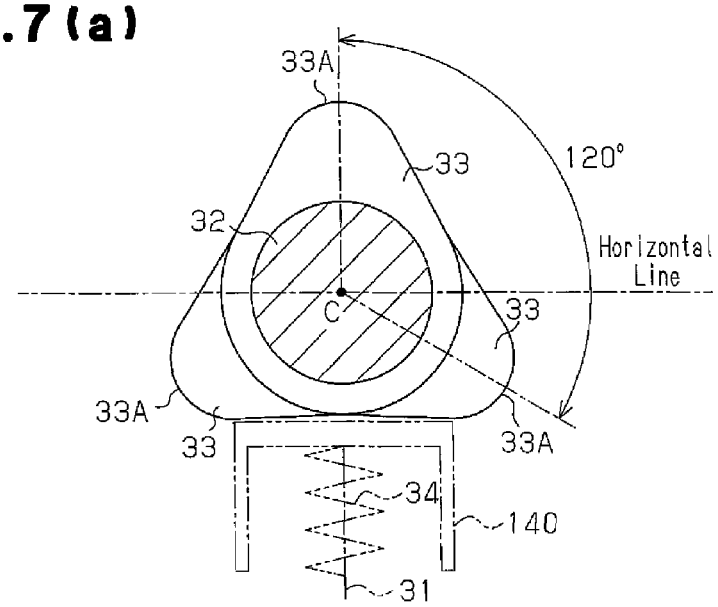
FIG. 7(*a*) is a cross-sectional view of a camshaft of the valve timing controller at a neutral position as viewed from an end of the camshaft, and FIG. 7(*b*) is a schematic view showing the circulation of hydraulic oil and air in the variable mechanism when the engine is stopped.
Figure 7B:
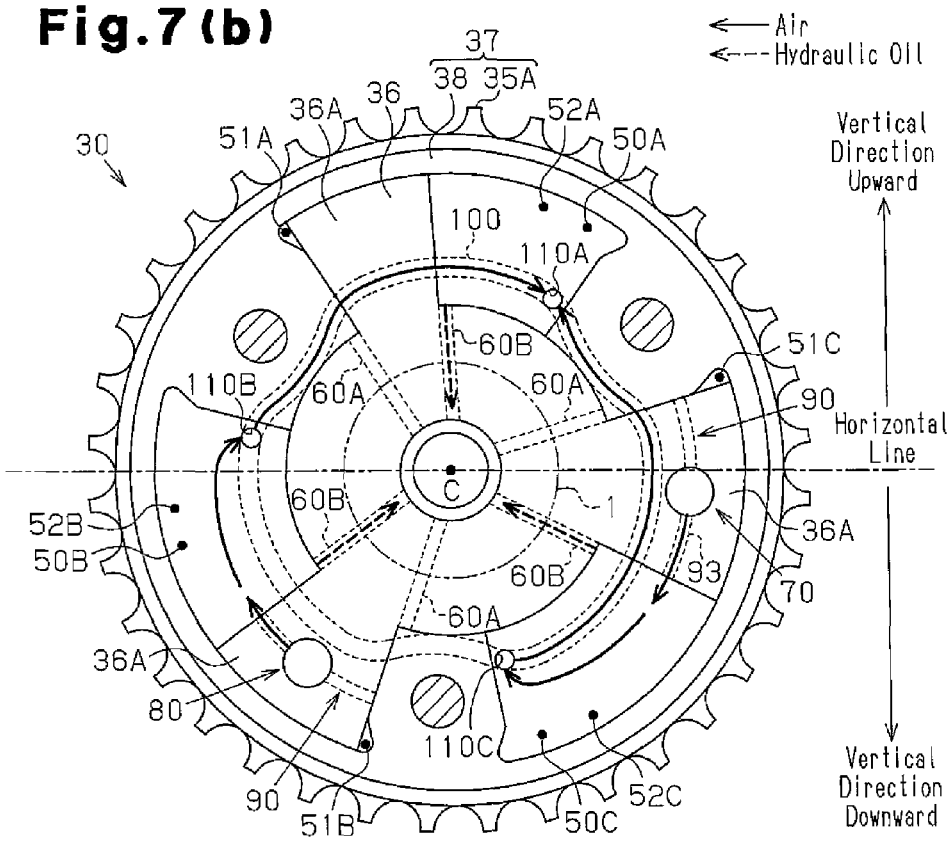

Referring to FIG. 7, the profile of the cam 33 arranged on the camshaft 32 will now be described. The single-dashed line in the drawing is a horizontal line extending through the axis C of the camshaft 32. FIG. 7(*b*) shows a state in which the valve timing is at the most retarded phase and the rotation of the vane rotor 36 is stopped.

As shown in FIG. 7(*a*), the camshaft 32 includes three cams 33 respectively corresponding to cylinders of the internal combustion engine. The profiles of the cams 33 are set so that the vertices of cam noses 33A are located at intervals of 120° around the camshaft 32 as viewed from an end side of the camshaft 32. Lifters 140, which open and close the intake valves 31, are arranged in contact with the cams 33 by the urging force of the valve springs 34.

Referring to FIG. 7(*a*), when the engine is stopped, there is a high probability of the rotation of the camshaft 32 being stopped in a state in which none of the lifters 140 are lifted by the cam noses 33A, that is, a state in which the lifters 140 are not in contact with the cam noses 33A. In other words, there is a high probability of the rotation of the camshaft 32 being stopped in a state in which the torque applied by the cams 33 to the camshaft 32 is smallest. The position at which there is a high probability of the rotation of the camshaft 32 being stopped is referred to as a neutral position.

FIG. 7(*b*) shows the vane rotor 36 and the housing rotor 37 in a state in which rotation of the camshaft 32 is stopped at the neutral position.

In this case, as shown in FIG. 7(*b*), the hydraulic pressure chambers 51A and 52A are located upward in the vertical direction of the horizontal line, and the hydraulic pressure chambers 51B, 52B, 51C, and 52C are located downward from the hydraulic pressure chambers 51A and 52A. In this case, the second opening 110B is located upward in the vertical direction from the horizontal line. In other words, the profile of the cams 33 is set so that the second opening 110B is located upward in the vertical direction from the horizontal line when the camshaft 32 is at the neutral position. Thus, in the present embodiment, the camshaft 32 corresponds to a stop phase adjustment mechanism in which the profile of the cams 33 is set based on the relationship of the stop position of the vane rotor 36 at the most retarded phase relative to the housing rotor 37.

When air is drawn into the second retardment chamber 52B and the third retardment chamber 52C by the open-to-atmosphere mechanism 90, the air drawn into the second retardment chamber 52B is further drawn from the second opening 110B through the communication passage 100 to the first retardment chamber 52A. Further, the air drawn into the third retardment chamber 52C is further drawn from the third opening 110C through the communication passage 100 into the first retardment chamber 52A. In this manner, air is drawn from the openings 110B and 110C into the first retardment chamber 52A through the communication passage 100. This results in hydraulic oil flowing from the first retardment chamber 52A towards the axis C of the camshaft 32 through the retardment oil passage 60B and then being discharged. The first retardment chamber 52A is in communication with the retardment chambers 52B and 52C, which are open chambers, through the communication passage 100 and serves as a drawing chamber.

The present embodiment described above has the following advantages.

(1) The profile of the cam 33 is set so that when the camshaft 32 is located at the neutral position, the second opening 110B of the communication passage 100 that opens in the second retardment chamber 52B is located upward in the vertical direction from the axis C of the camshaft 32.

Thus, when a certain amount of hydraulic oil flows out of the second retardment chamber 52B through the communication passage 100, an oil-filled state of the second retardment chamber 52B is resolved, and a void is formed in the vicinity of the second opening 110B. After the formation of such a void, air flows into the second opening 110B of the communication passage 100 without being obstructed by hydraulic oil. Thus, air can be efficiently drawn into the first retardment chamber 52A.

As described above, when the engine is stopped and the valve timing is not locked at the intermediate phase, the valve timing is often at a phase that is relatively retarded due to the influence of cam friction or the like. More specifically, in such a case, the valve timing is most often at the most retarded phase. In this state, each retardment chamber 52 is in an oil-sealed state if hydraulic oil is not appropriately discharged from each retardment chamber 52. Thus, when the rotation of the camshaft 32 rotates the vane rotor 36, the housing rotor 37 rotates in cooperation with the vane rotor 36. In other words, the two rotating bodies are rotated integrally. Thus, in a structure in which the second opening 110B is formed in the plate 35B of the housing rotor 37 like in the present embodiment, by setting the profile of the cams 33 so that the second opening 110B is located upward in the vertical direction from the axis C of the camshaft 32 when the camshaft 32 is at the neutral position in a state in which the valve timing is at the most retarded phase, a void is formed in the vicinity of the second opening 110B. This obtains the advantages described above.

Further, the hydraulic oil remaining in each retardment chamber 52 resists being discharged when each retardment chamber 52 is located downward in the vertical direction from the horizontal line. However, when the vane rotor 36 and the housing rotor 37 are rotated after the engine is started and the retardment chambers 52B and 52C are arranged upward in the vertical direction from the horizontal line, air is directly drawn by the open-to-atmosphere mechanism 90 into the retardment chambers 52B and 52C defined and formed by the vane 36A, which includes the open-to-atmosphere mechanism 90. This readily discharges the remaining hydraulic oil. In contrast, even when the vane rotor 36 and the housing rotor 37 are rotated and the first retardment chamber 52A is arranged upward in the vertical direction from the horizontal line after the engine is started, ambient air is not directly drawn in the first retardment chamber 52A defined and formed by the vane 36A, which does not include the open-to-atmosphere mechanism 90. Thus, the remaining hydraulic oil resists being discharged. This requires the hydraulic oil remaining in the first retardment chamber 52A to be discharged when the engine is stopped.

As described above, the valve timing controller of the present embodiment can readily discharge the hydraulic oil remaining in the first retardment chamber 52A when the engine is stopped.

(2) If the valve timing is not locked at the intermediate phase when the engine is stopped, the valve timing is often gradually retarded. In particular, there is a strong demand to readily discharge hydraulic oil from each retardment chamber 52 as described above.

By using the second retardment chamber 52B and the third retardment chamber 52C as open chambers and the first retardment chamber 52A as a drawing chamber, when the open-to-atmosphere mechanism 90 draws air into the retardment chambers 52B and 52C, which are open chambers, a large amount of air is drawn through the communication passage 100 into the first retardment chamber 52A, which is a retardment chamber that differs from the retardment chambers 52B and 52C. As a result, even when the valve timing is stopped at the retarding side when the engine is stopped, hydraulic oil is readily discharged through the retardment oil passage 60B from of the drawing chamber, that is, the first retardment chamber 52A.

(3) Further, the necessity to discharge hydraulic oil from each advancement chamber 51 and each retardment chamber 52 becomes low in a lock mechanism that locks the valve timing at the most retarded phase rather than at the intermediate phase, for example. The lock mechanisms 70 and 80 cooperate to lock the valve timing at the intermediate phase between the most advanced phase and the most retarded phase. Thus, the necessity to swing the vane rotor 36, that is, the necessity to discharge hydraulic oil from each advancement chamber 51 and each retardment chamber 52 becomes high. The valve timing controller of the present embodiment can readily discharge the hydraulic oil from each retardment chamber 52 when the valve timing is stopped at the most retarded phase, for example. Thus, advantages (1) and (2) become further prominent.

(4) The retardment chambers 52A to 52C are in communication with each other through the openings 110A to 110C formed in the plate 35B and the annular communication passage 100 formed in the sprocket 35A. Thus, the structure of the communication passage is simplified compared to a structure in which a communication passage that communicates the first retardment chamber 52A and the second retardment chamber 52B is separated from a communication passage that communicates the first retardment chamber 52A and the third retardment chamber 52C.

A valve timing controller according to the present invention is not limited to the structure exemplified in the above embodiment and may be modified and practiced, for example, in the forms described below.

The second opening 110B may be arranged in the vane rotor 36. In this case, rotation of the camshaft 32 can directly rotate the vane rotor 36. Thus, by setting the profile of the cam 33 of the camshaft 32, the second opening 110B can be located upward in the vertical direction from the axis C of the camshaft 32 even when the valve timing is not at the most retarded phase.

In a structure in which the second opening 110B is arranged in the housing rotor 37, when the engine is stopped, the engine starting device may be driven to rotate the crankshaft 11 and adjust the stop phase of the housing rotor 37 so that the second opening 110B is located upward in the vertical direction from the axis C of the camshaft 32. The engine starting device may be the starter motor 24. In this case, the starter motor 24 is preferably of a constant meshing type. Further, the engine starting device may be an electrical power generator in a hybrid vehicle.

The load of an auxiliary machine driven by the crankshaft 11 when the engine is stopped may be controlled. In such a structure, by adjusting the stop phase of the crankshaft 11 to adjust the stop phase of the housing rotor 37, the second opening 110B can be located upward in the vertical direction from the axis C of the camshaft 32 when the engine is stopped.

An examples of such an auxiliary machine is a rotary pump, namely, the oil pump 20 or the like driven by a power generator or the crankshaft 11.

Further, as described above, if the valve timing is not locked at the intermediate phase when the engine is stopped, the valve timing has a high probability of being at the most retarded phase, and the two rotating bodies are integrally rotated if the hydraulic oil is not appropriately discharged from each retardment chamber 52. Thus, in a structure in which the second opening 110B is arranged in the vane rotor 36, when the engine is stopped and the valve timing is at the most retarded phase, the engine starting device is driven to rotate the crankshaft 11 and adjust the stop phase of the housing rotor 37 so that the second opening 110B is located upward in the vertical direction from the axis C of the camshaft 32 as described above.

In the same manner, in a structure in which the second opening 110B is arranged in the vane rotor 36, when the engine is stopped and the valve timing is at the most retarded phase, the load of the auxiliary machine driven by the crankshaft, as described above, is controlled to control the stop phase of the crankshaft 11 and adjust the stop phase of the housing rotor 37.

The retardment chambers 52A to 52C are is communication with each other through the communication passage 100. However, the retardment chambers 52B and 52C do not have to be in communication.

The retardment chambers 52A to 52C are in communication with each other through the communication passage 100. However, any ones of the advancement chambers 51 may be in communication with each other through the communication passage. Further, when any ones of the advancement chambers 51 are in communication with each other through the communication passage, any ones of the retardment chambers 52 may be in communication with each other through the communication passage. Any of the advancement chambers 51 and any of the retardment chambers 52 may be in communication with the communication passage. In this case, preferably, reduction in the operational responsiveness of the valve timing controller is suppressed by using a throttle that relatively reduces the flow area in the communication passage.

The communication passage 100 is arranged in the plate 35B. However, the communication passage 100 may be arranged in the cover 39 or the vane rotor 36.

The open-to-atmosphere mechanism 90 communicates every one of the second advancement chamber 51B, the second retardment chamber 52B, the third advancement chamber 51C, and the third retardment chamber 52C with the exterior and draws air into each of the hydraulic pressure chambers 51B, 52B, 51C, and 52C but may communicate one of the hydraulic pressure chambers 51B and 52B and one of the hydraulic pressure chambers 51C and 52C with the exterior.

The profile of the cams 33 of the camshaft 32 is set so that the second opening 110B is located upward in the vertical direction from the axis C of the camshaft 32. However, the profile of the cams 33 of the camshaft 32 may be set so that the third opening 110C is arranged in the same direction.

A structure in which the lock pin 71A moves in the axial direction of the vane rotor 36 is used for the lock mechanisms 70 and 80 but may be changed to a structure in which the lock pin 71A moves in the radial direction of the vane rotor 36. In other words, the lock pin 71A may be arranged in the vane 36A so that the lock pin 71A moves in the radial direction of the vane rotor 36, and the lock groove 73 may be arranged in a portion of the housing rotor 37 corresponding with the lock pin 71A.

The subject of control for the valve timing controller of the embodiment described above is an in-line three cylinder internal combustion engine in which the cams 33 are arranged so that the vertices of the cam noses 33A are arranged at intervals of 120° around the center axis of the camshaft 32. However, the internal combustion engine that is the control subject of a valve timing controller according to the present invention is not limited to an in-line three cylinder internal combustion engine. For example, the present invention may be embodied in a valve timing controller for an in-line four cylinder internal combustion engine. In such a case, the neutral position of the camshaft appears in intervals of 90° in the rotating direction of the camshaft.

The present invention is embodied in a valve timing controller that varies the valve timing of the intake valves 31. However, the present invention may be embodied in a valve timing controller that varies the valve timing of the exhaust valves 41.

DESCRIPTION OF REFERENCE CHARACTERS

10: internal combustion engine, 11: crankshaft, 12: sprocket, 13: timing chain, 20: oil pump (auxiliary machine), 21: oil pan, 22: hydraulic oil passage, 23: oil passage control valve, 24: starter motor (engine starting device), 25: battery, 30: variable mechanism, 31: intake valve, 32: intake camshaft, 33: intake cam, 33A: cam nose, 34: intake valve spring, 35A: sprocket, 35B: plate, 36: vane rotor (second rotating body), 36A: vane, 36B: boss, 37: housing rotor (first rotating body), 38: housing main body, 38A: partition wall, 39: cover, 41: exhaust valve, 42: exhaust camshaft, 43: exhaust cam, 44: exhaust valve spring, 45: sprocket, 50: accommodation chamber, 51A: first advancement chamber, 51B: second advancement chamber, 51C: third advancement chamber, 52A: first retardment chamber (drawing chamber), 52B: second retardment chamber (open chamber), 52C: third retardment chamber (open chamber), 60A: advancement oil passage, 60B: retardment oil passage, 70: lock mechanism, 71A: main lock pin, 71B: auxiliary lock pin, 72: accommodation hole, 73: lock groove, 73A: lower groove, 73B: upper groove, 73C: advancement inner wall, 74: spring guide bushing, 75: ring bushing, 76A: main spring, 76B: auxiliary spring, 77: release chamber, 78: release oil passage, 79: flange, 80: lock mechanism, 90: open-to-atmosphere mechanism, 91: open passage, 92: advancement chamber open passage, 93: retardment chamber open passage, 100: communication passage, 110A: first opening, 110B: second opening, 110C: third opening, 120: bolt hole, 130: bolt hole, 140: lifter, 150: control unit, 151: crank angle sensor, 152: cam angle sensor, 153: coolant temperature sensor.

The invention claimed is:

1. A valve timing controller for an internal combustion engine comprising:

a variable mechanism that varies a relative rotation phase of a first rotating body, which moves in cooperation with a crankshaft, and a second rotating body, which moves in cooperation with a camshaft and rotates about a same axis as the first rotating body, based on hydraulic pressure of a plurality of hydraulic pressure chambers defined by the two rotating bodies;

a lock mechanism that locks the relative rotation phase at a specific phase; and a plurality of discharge passages that extend from the plurality of hydraulic pressure chambers towards the same axis to discharge hydraulic oil from each of the plurality of hydraulic pressure chambers;

an open-to-atmosphere mechanism that communicates an open chamber, which is one of the plurality of hydraulic pressure chambers, with the exterior when the engine is stopped to draw air into the open chamber;

a communication passage that communicates a drawing chamber, which is one of the plurality of hydraulic pressure chambers that differs from the open chamber, with the open chamber, wherein the communication passage includes an opening that opens to the open chamber; and a stop phase adjustment mechanism that adjusts a stop phase of at least one of the two rotating bodes so that the opening of the communication passage is located upward in a vertical direction from the same axis when the engine is stopped.

2. The valve timing controller of the internal combustion engine according to claim 1, wherein the open chamber and the drawing chamber are separate retardment chambers that retard the valve timing.

3. The valve timing controller of the internal combustion engine according to claim 2, wherein, the opening is arranged in the first rotating body; and the stop phase adjustment mechanism includes the camshaft, wherein the camshaft includes a cam having a profile set so that the opening is located upward in the vertical direction from the axis when torque applied from the cam to the camshaft becomes smallest in a state in which the second rotating body is located at a most retarded phase relative to the first rotating body.

4. The valve timing controller of the internal combustion engine according to claim 1, wherein, the opening is arranged in the second rotating body; and the stop phase adjustment mechanism includes the camshaft, wherein the camshaft includes a cam having a profile set so that the opening is located upward in the vertical direction from the axis when torque applied from the cam to the camshaft becomes smallest.

5. The valve timing controller of the internal combustion engine according to claim 1, wherein, the opening is arranged in the first rotating body; and the stop phase adjustment mechanism adjusts the stop phase of the first rotating body by driving an engine starting device and rotating the crankshaft so that the opening is located upward in the vertical direction from the axis when the engine is stopped.

6. The valve timing controller of the internal combustion engine according to claim 2, wherein, the opening is arranged in the second rotating body; and the stop phase adjustment mechanism adjusts the stop phase of the first rotating body by driving an engine starting device and rotating the crankshaft so that the opening is located upward in the vertical direction from the axis when the engine is stopped in a state in which the second rotating body is located at a most retarded phase relative to the first rotating body.

7. The valve timing controller of the internal combustion engine according to claim 1, wherein, the opening is arranged in the first rotating body; and the stop phase adjustment mechanism adjusts the stop phase of the first rotating body by controlling load of an auxiliary machine, which is driven by the crankshaft, when the engine stops so that the opening is located upward in the vertical direction from the axis when the engine is stopped.

8. The valve timing controller of the internal combustion engine according to claim 2, wherein, the opening is arranged in the second rotating body; and the stop phase adjustment mechanism adjusts the stop phase of the first rotating body by controlling load of an auxiliary machine, which is driven by the crankshaft, when the engine is stopped so that the opening is located upward in the vertical direction from the axis when the engine is stopped in a state in which the second rotating body is located at a most retarded phase relative to the first rotating body.

9. The valve timing controller of the internal combustion engine according to claim 1, wherein the specific phase is an intermediate phase between a most advanced phase and a most retarded phase.

* * * * *